US009259950B2

(12) United States Patent
Samweber et al.

(10) Patent No.: US 9,259,950 B2
(45) Date of Patent: Feb. 16, 2016

(54) INK PRINTING APPARATUS, AND METHOD TO CONTROL THE DRIVING OF A PRINTING APPARATUS

(71) Applicant: Oce Printing Systems GmbH & Co. KG, Poing (DE)

(72) Inventors: Joachim Samweber, Eichenau (DE); Peter Thiemann, Munich (DE); Stefan Cor, Neufahrn (DE); Christian Kuermeier, Erding (DE)

(73) Assignee: Oce Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/683,418

(22) Filed: Apr. 10, 2015

(65) Prior Publication Data

US 2015/0290957 A1 Oct. 15, 2015

(30) Foreign Application Priority Data

Apr. 11, 2014 (DE) ..... 10 2014 105 209

(51) Int. Cl.
*B41J 2/01* (2006.01)
*B41J 29/393* (2006.01)
*B41J 13/00* (2006.01)

(52) U.S. Cl.
CPC ..... *B41J 29/393* (2013.01); *B41J 13/0009* (2013.01)

(58) Field of Classification Search
CPC ..... B41J 29/393; B41J 2/01; B41J 13/0009; B41J 11/0005
See application file for complete search history.

(56) References Cited

U.S. PATENT DOCUMENTS

| | | | | |
|---|---|---|---|---|
| 4,779,783 | A | 10/1988 | Fischer et al. | |
| 6,318,916 | B1 | 11/2001 | Hofmann | |
| 6,375,296 | B1 | 4/2002 | McGarry et al. | |
| 7,883,204 | B2 * | 2/2011 | Shinkawa | B41J 11/0005 271/197 |
| 2008/0143807 | A1 | 6/2008 | Bartley et al. | |

FOREIGN PATENT DOCUMENTS

| | | | |
|---|---|---|---|
| DE | 4107798 | C1 | 10/1992 |
| EP | 0164651 | B1 | 5/1987 |
| EP | 1 047 559 | B1 | 3/2002 |
| EP | 0788882 | B1 | 7/2002 |

* cited by examiner

*Primary Examiner* — Thinh Nguyen
(74) *Attorney, Agent, or Firm* — Schiff Hardin LLP

(57) ABSTRACT

A printing unit prints to a pre-folded substrate web. An intake unit is at an intake of a transport arrangement. A synchronization sensor is at the transport arrangement between an infeed roller and the printing unit. The synchronization sensor emits a synchronization signal when a fold of the web is present at the synchronization sensor for synchronization of a printing operation with feed of the web. A path between the synchronization sensor and a freely accessible point of the intake unit is designed such that a fold is present at the synchronization sensor when the printing substrate web has a fold at the accessible point. A relative humidity sensor is at the printing unit. A relative humidity measured by the sensor is compared with a relative humidity of an input stack. Given a deviation a length change of the web between the synchronization sensor and the accessible point is calculated, the web being displaced by the length change at the accessible point.

8 Claims, 2 Drawing Sheets

INK PRINTING APPARATUS, AND METHOD TO CONTROL THE DRIVING OF A PRINTING APPARATUS

BACKGROUND

Ink printing apparatuses can be used for single-color or multicolor printing of a printing substrate, for example of a single sheet or of a web-shaped printing substrate made of the most varied materials (paper, for example). The design of such ink printing apparatuses is known; see for example EP 0 788 882 B1. Ink printing apparatuses that, for example, operate according to the Drop-on Demand (DoD) principle have as a printing unit a print head or multiple print heads with nozzle units comprising ink channels and activators, wherein the activators—controlled by a printer controller—can excite ink droplets in the direction of the printing substrate, which ink droplets are directed onto the printing substrate in order to apply print dots for a print image there. The activators can generate ink droplets thermally (bubble jet) or piezoelectrically.

The processing of a printing substrate web as a stacked good should be possible in an ink printing apparatus that prints with high print speeds (>=75 m/min). It is thereby to be taken into account that these ink printing apparatuses have a long printing substrate path (transfer-printing zone with multiple print bars, drying routes) that is typical of an inkjet. This applies in particular given processing of stacked goods in a full-color high-capacity inkjet printer.

A method to control a drive for a printing substrate web in a printing apparatus that prints to a pre-folded printing substrate web with marginal perforation is known from EP 1 047 559 B1. The printing substrate web is transported through the printing apparatus via a drive assembly controlled by a print controller. The printer controller receives signals from a sensor that are dependent on the feed of the printing substrate web. For this, a sprocket is provided whose spokes engage in the marginal perforation of the printing substrate web and is entrained by this. Depending on this, the sensor signals are generated from which the feed velocity of the printing substrate web can be calculated. This is compared with a desired velocity and, given deviations, the feed velocity of the printing substrate web is corrected. Upon insertion of a new printing substrate web, this is manually drawn in by the operator up to the drive assembly. A straight edge on which the printing substrate web can be aligned is arranged on a guide surface at the drive assembly. With a drive motor, the printing substrate web is moved until the beginning of a page rests on a marking on the straight edge. The printing substrate web can subsequently be moved through the printing unit with print velocity.

The feeding of a new printing substrate web into the printing apparatus can also take place in that the new printing substrate web is adhered to a printing substrate web that is already threaded into the printing apparatus and is pulled by this through the printing apparatus. In this case, a synchronization (for example at a fold of the printing substrate web) must take place in the printing apparatus with the aid of a synchronization sensor in order to establish the position of the print images on the printing substrate web. Since the synchronization sensor should be situated before the printing unit of the printing apparatus near its intake, this alignment of the printing substrate web must take place in the printing apparatus, thus at a point in the printing apparatus that is difficult to access. It is thereby to be taken into account that the length of a printing substrate web is dependent on the climate conditions in the region of the printing apparatus, is additionally different for different types of printing substrate web, and additionally can change before the insertion of the printing substrate web into the printing apparatus. A change of the length of the printing substrate web should thus be taken into account, meaning that the synchronization (for example at a fold of the printing substrate web) must be corrected in order to achieve a correct print image on the printing substrate web.

SUMMARY

It is an object to specify an ink printing apparatus and a method to control the drive of a printing apparatus that can process printing substrate webs embodied as stacked goods, wherein the print image may not be degraded given changing climate conditions for the printing substrate web or for different printing substrate types.

An ink printing apparatus printing unit and a printer controller are provided for printing to a pre-folded printing substrate web. A transport arrangement is provided for the printing substrate web. An intake unit is arranged at an intake of the transport arrangement. An infeed roller is provided at an intake for the transport arrangement to transport the printing substrate web to the transport arrangement. A synchronization sensor is arranged at the transport arrangement between the infeed roller and the printing unit. The synchronization sensor emits a synchronization signal when a fold of the printing substrate web is present at the synchronization sensor for synchronization of a printing operation with feed of the printing substrate web. A transport path between the synchronization sensor and a freely accessible point of the intake unit is designed such that a fold is present at the synchronization sensor when the printing substrate web has a fold at the freely accessible point. A sensor for measurement of relative humidity is arranged at the printing unit. A measurement signal of the relative humidity by the sensor is compared with a relative humidity of an input stack of a printing substrate web to be inserted into the printing apparatus. Given a deviation the printer controller calculates a length change of the printing substrate web between the synchronization sensor and the freely accessible point, the printing substrate web being displaced by the length change at the freely accessible point.

DESCRIPTION OF EXEMPLARY EMBODIMENTS

Figure 1:
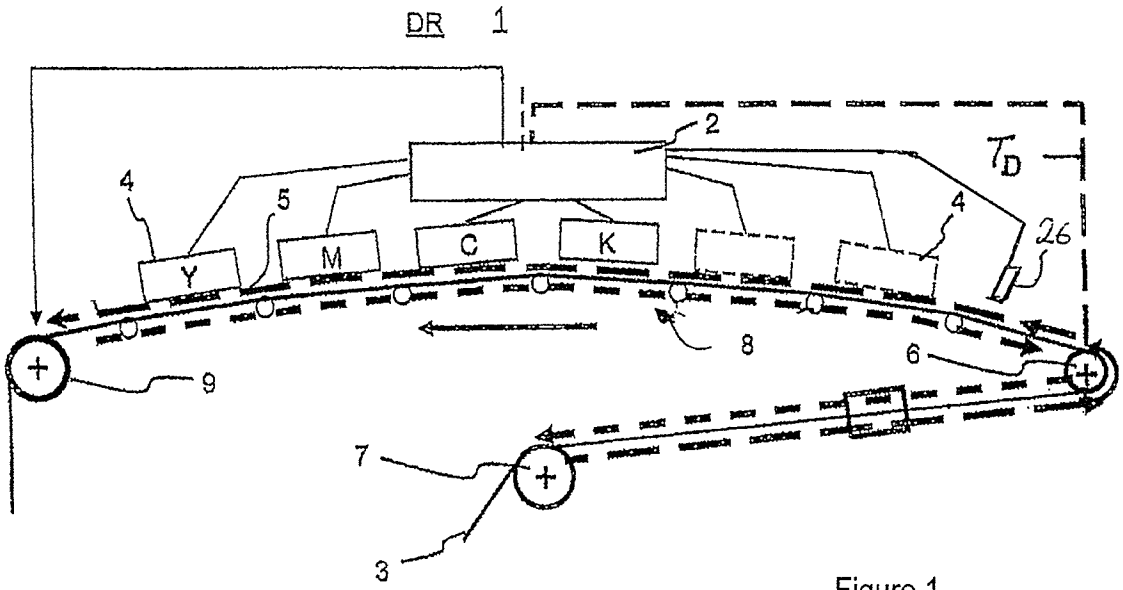
Prior art Figure 1
FIG. 1 illustrate a printing unit of an ink printing apparatus (prior art)

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

In an ink printing apparatus, a printer controller and a printing unit for printing to a printing substrate web are provided, which printing unit has print bars comprising print heads and a drying route. The printing substrate web is transported through the printing unit with a transport arrangement. Arranged at the intake of the transport arrangement is an intake unit that has an infeed roller in order to transport the printing substrate web to the transport arrangement. The intake unit can provide an adhesion device for printing substrate webs. A synchronization sensor can be arranged at the transport arrangement, between the infeed roller and the printing unit, which synchronization sensor emits synchronization signals when a fold of the printing substrate web travels past the synchronization sensor, which synchronization signals serve for synchronization of the printing operation with the feed of the printing substrate web. The transport path between the synchronization sensor and the intake unit and a point of the intake unit that is freely accessible from the outside is executed or is set by the printer controller via the position of the transport rollers to drive the printing substrate web so that the printing substrate web has a fold at the synchronization sensor when a fold is present at the freely accessible point of the intake unit. The adhesion device can be selected as a freely accessible point of the intake unit. If environment conditions (for example the relative humidity) at the printing apparatus are different than the environment conditions at which a stack of the printing substrate web that is to be fed into the printing apparatus was stored, this leads to a change in length of the printing substrate web. The printer controller can calculate this length change and adjust the drive controller so that the printing substrate web is displaced by the length change at the freely accessible point of the intake unit and a fold of the printing substrate web is present at the synchronization sensor.

Advantages of the exemplary embodiment are:

- Printing substrate webs should be connected with one another without a correction of the length of the printing substrate web needing to be made manually.
- Short times should be necessary for a stack change. The alignment of the position of the printing substrate web relative to the synchronization sensor takes place at the adhesion device, for example, and not in the printing apparatus.
- The start of the output unit can take place more quickly without correction of the length of the printing substrate web by the operator.

Exemplary embodiments are explained as shown in the schematic drawing figures.

A printing unit 1 and a printer controller of an ink printing apparatus DR are shown in FIG. 1. Arranged along a printing substrate web 3 is a printing unit 1 that has print bars 4 with a print head or multiple print heads 5 one after another as viewed in the transport direction of the printing substrate web 3. For example, given color printing a respective print bar 4 can be provided per color to be printed. With the aid of a take-off roller 9, the printing substrate web 3 is moved past the print bars 4; it thereby lies on a saddle with guide rollers (called transport arrangement 8 in the following). At the intake of the printing unit 1, a rotary encoder wheel 6 is arranged that is driven by the printing substrate web 3 and that generates rotary encoder pulses $T_D$ depending on the feed movement of the printing substrate web 3, which rotary encoder pulses $T_D$ are supplied to the printer controller 2 and are used by said printer controller 2 in order to establish the point in time of the triggering of the printing process at the individual print heads 5. At the output of the printing unit 1, heating saddles 10 are provided that form a drying route 11 (shown in FIG. 2) for the printing substrate web 3 to be printed to in the printing unit 1.

The ink printing apparatus DR has an intake unit EG for a printing substrate web 3 at the intake of the printing unit 1 and has a receiver unit AG for the printed printing substrate web 3 at the output of the drying route 11. The transport of the printing substrate web 3 through the ink printing apparatus DR from the intake unit EG to the receiver unit AG is implemented with the aid of the transport arrangement 8 for the printing substrate web 3. Provided at the output of the intake unit EG is a driven infeed roller 12 that supplies the printing substrate web 3 to the printing unit 1. Provided at the output of the printing unit 1 is a driven take-off roller 13 that supplies the printed printing substrate web 3 to the receiver unit AG. The transport arrangement 8 thereby encompasses the transport path of the printing substrate web 3 from the infeed roller 12, across a rotating frame 16, through the printing unit 1 and the drying route 11, to the take-off roller 13.

Figure 2:
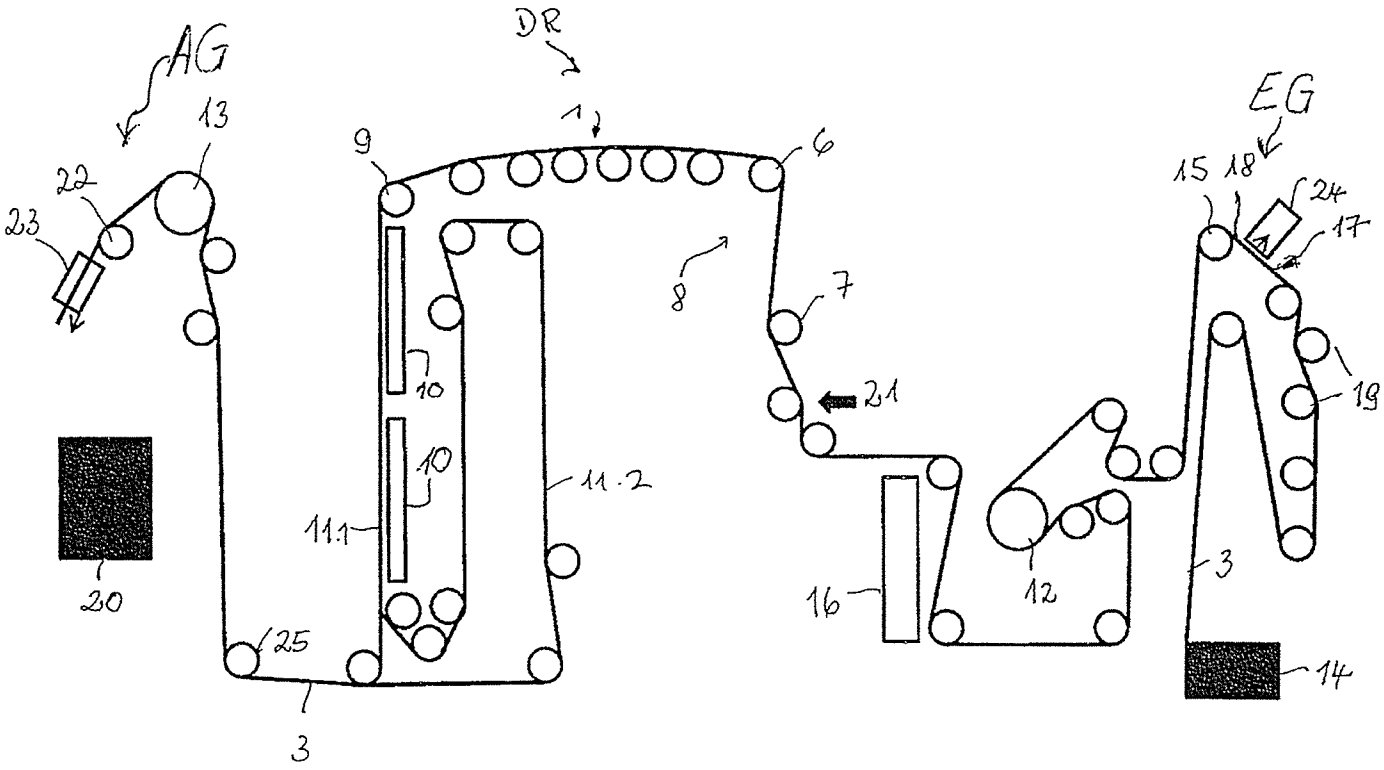
FIG. 2 illustrates a transport arrangement to transport a printing substrate web in stack form through the printing apparatus.

FIG. 2 shows the schematic design of such a transport arrangement 8 for the processing of the printing substrate web 3 in stack form (stacked good). According to FIG. 2, the printing apparatus DR has: the arrangement 8 for transport of a printing substrate web 3 through the printing apparatus DR; a storage container 14 for the stacked good; the intake unit EG for the printing substrate web 3 at the intake of the printing unit 1; and a receiver unit AG for the printed printing substrate web 3 at the output of the printing unit 1. The printing substrate web 3 is supplied from the storage container 14 to the intake unit EG; for example, it travels over a braking roller 15 and, for example, via the rotating frame 16 and additional rollers to the printing unit 1. The printing substrate web 3 can be aligned via the rotating frame 16 before the printing substrate web 3 is supplied to the printing unit 1. The printing substrate web 3 is directed via the drying route 11 at the output of the printing unit 1 and is thereby dried. From the drying route 11 the printing substrate web 3 is supplied to the receiver unit AG. For this, the take-off roller 13 is arranged before the receiver unit AG so that the printed printing substrate web 3 can be stored in a stack 20 in the receiver unit AG. The storage container 14 can be arranged under the intake unit EG, and in fact below the adhesion device 17. The printing substrate web 3 can then be supplied via deflection rollers 19 to the adhesion device 17. From there, the printing substrate web 3 is directed through the printing unit 1 to the receiver unit AG, corresponding to FIG. 2. Arranged at the output of the printing unit 1 is the receiver unit AG, which provides a stack output with a placement or folding roller 22 and an oscillating or rocker guide 23 via which the printing substrate web 3 is placed on the stack 20.

The intake unit EG for the printing substrate web 3 is schematically shown in FIG. 2. The intake unit EG in particular shows the adhesion device 17 that is integrated into a placement surface 18 and can be designed as an oblique plane. Furthermore, it is indicated how the printing substrate web 3 is supplied from the storage container 14 to the placement surface 18.

After being adhered to the already inserted printing substrate web 3, the new printing substrate web 3 to be inserted is drawn into the printing unit 1 by the already inserted printing substrate web 3 via movement of the drive motors and is conveyed to the receiver unit AG.

The printing substrate output is designed so that stacked goods can be stored in the receiver unit AG. The pre-folded printing substrate web 3 is thereby stored in zigzag folds on the stack 20 with the aid of the oscillating guide 23. For this, the oscillating guide 23 executes oscillation movements synchronized with the folding of the printing substrate web 3.

Full-color inkjet ink printing apparatuses differ from (for example) toner printers with regard to the web path in the following points, among others:

The web path length in the ink printing apparatus DR is significantly longer (for example due to the length of the transfer printing zone, length of the drying route).

The web path routes traversed during the acceleration phases are significantly longer since the accelerations due to existing inertias are smaller.

Therefore, in spite of these details precautions are taken in the transport of a printing substrate web 3 in order to be able to simply draw in a new printing substrate web 3 and in order to generate less spoilage length at the start and end of a feed stack.

The adhesion device 17 that is described above is used to draw in a new printing substrate web 3. Due to the alignment of the printing substrate web 3 that is ensured in the adhesion device 17, the new printing substrate web 3 is reliably drawn in orthogonal to the deflection rollers 19, i.e. without web path disruptions such as ridge formation, folding or web tears. Furthermore, upon intake of the printing substrate web 3 the rotating frame 16 can be adjusted so that (for example) lateral movements of the rotating frame 16 are limited in their velocity and magnitude so that paper tears upon insertion of (for example) the stacked good are prevented.

The feed of a printing substrate web 3 inserted into the printing apparatus DR is ended when this has been printed and a new printing substrate web 3 should be drawn into the printing apparatus DR. After it has stopped, the last printed information is situated just after the last print bar 4, and the end of the printing substrate web 3 is situated just before the adhesion device 17. The operator can now move the printing substrate web 3 further. From the calculation of (for example) the fold position of the previously detected stack end, and with the aid of an optical sensor ("paper end adhesion point") that is positioned just before the adhesion point 24, the printer controller 2 moves the end of the printing substrate web 3 precisely to the adhesion point 24. This enables the start of a new printing substrate web 3 to be adhered to the existing end of the previously printed printing substrate web 3 and to be drawn into the ink printing apparatus DR. At the same time, the printed printing substrate web 3 is transported to the receiver unit AG and can be removed from the receiver unit AG after intake of the new printing substrate web 3. Only at most the length of the printing substrate web 3 from the adhesion point 24 up to the take-off roller 13 is thus incurred as spoilage. It is a requirement that printing via the ink printing apparatus DR can take place after adhesion and running through of the adhesion point 24.

The spoilage can be further reduced if the length of the printing substrate web 3 from the storage container 14 to the receiver unit AG is shortened. The described printing substrate transport 8 has the possibility of shortening the drying route 11. This is in particular possible given stacked goods since the quantity of consumed ink here is for the most part small. If the printing substrate web 3 is inserted into the shortened drying route 11.1, this can be communicated to the printer controller 2 via a sensor. The printer controller 2 thus knows the printing substrate length that is present in the ink printing apparatus DR and the printing substrate path that is used.

In continuous printing operation, via the intake unit EG it is ensured that the printing substrate web 3 is supplied with a uniform web tension to the web segment of the transfer printing under the print bars 4, and the disruptions due to the unfolding and the web transport of the sheets of the stable good are minimized. The printing substrate web 3, which arrives loose from the storage container 14, can be pre-centered via lateral funnel-shaped guide plates and be charged with web tension via the braking roller 15, and thus be supplied to the infeed roller 12 without disruption.

In the output to the receiver unit AG, the take-off roller 13 charges the printing substrate web 3 coming from the intake unit EG with web tension, and thus provides for a disruption-free travel of the printing substrate web 3 through the printing unit 1 and a disruption-free transport into the receiver unit AG.

To control the printing process, it should be known to the printer controller 2 when the printing substrate web 3 (in particular the individual sheets of the printing substrate web 3) is situated at the print bars 4 in the correct position for printing; this means that the printing substrate web 3 should be synchronized with the print bars 4. The folds of the sheets of the printing substrate web 3 can be used for synchronization since a fold represents the start of a sheet. The marginal perforations or other position markers that are situated adjacent to a fold on the printing substrate web can be determined with a synchronization sensor 21 of known design, and with this the fold between two sheets can be established so that the synchronization sensor 21 can generate a synchronous signal when a fold is present at the synchronization sensor 21. The synchronization sensor 21 can be arranged between the rotating frame 16 and the intake of the printing unit 1; and it should advantageously be arranged as close as possible to the intake of the printing unit 1. Upon drawing a new printing substrate web 3 into the printing apparatus DR, due to the synchronization between sheet position of the printing substrate web 3 and print bars 4 relative to one another—which synchronization is required for printing—the printing substrate web 3 should be positioned so that the fold (and therefore a start of a sheet) is situated at the synchronization sensor 21. This positioning could be implemented by an operator at the synchronization sensor 21 in the printing apparatus DR. However, this procedure is laborious, for example since the housing of the printing apparatus DR would need to be opened and the paper web inside the printing apparatus is difficult to access.

In order to ensure a correct position of the printing substrate web 3 relative to the synchronization sensor 21 upon drawing in a new printing substrate web 3, the length of the printing substrate web 3 from the intake unit EG—and in fact from a point of the intake unit EG that is freely accessible from the outside—to the synchronization sensor 21 can advantageously be used. If this is known, the position of a fold of the printing substrate web 3 at the synchronization sensor 21 can be concluded from the position of a fold of the printing substrate web 3 at the adhesion point 24. This means that it can be detected at the adhesion point 24 whether the printing substrate web 3 is situated with a fold at the synchronization sensor 21, and the synchronization sensor 21 can send a synchronization signal to the printer controller 2 that correctly identifies a fold of the printing substrate web 3 relative to the printing start of the printing unit 1, such that the print bars 4 can print the print images aligned to the fold on the sheets of the printing substrate web 3. However, if the length of a new printing substrate web 3 (which, for example, is adhered to an already printed printing substrate web 3) changes (for example, due to the climate conditions at the printing apparatus DR), but this change is not taken into account, this leads to the situation that the print image is no longer correctly printed on the printing substrate web 3 at the fold of the sheets since the synchronization signals are generated with a time offset. It would be advantageous if the length change of the printing substrate web 3 due to the change of the climate conditions at the printing substrate web 3 were known. The printing substrate web 3 could then be positioned at the adhesion point 24 such that the synchronization sensor 21 emits its sensor signal at a point in time at which the printer controller 2 sends the print start at the print bar 4 for a print image to the printing unit 1.

The thickness d and the width b of the printing substrate web 3, the web tension F on the printing substrate web 3 in the printing apparatus DR, and the change of the relative humidity rH at the printing apparatus DR can be used to calculate the length change. The relative humidity rH and the web tension F can be measured; and the thickness d and the width B of the printing substrate web 3 are known. For example, the web tension F can be measured with a sensor 25 that rests on the printing substrate web 3. For the length of the new printing substrate web 3, given a change of rH, F, B and d it then applies that:

a) length $L_{(new1)}$ between synchronization sensor 21 and adhesion point 24:

$L_{(new1)}$=(1+(ΔL per web tension F)+(ΔL per change of the relative humidity rH))*length L of the printing substrate web 3 (from the adhesion point 24 to the synchronization sensor 21), wherein ΔL is selected to be 1 mm, for example, and the length of the printing substrate web 3 is specified in mm.

This calculation can also be used for the length of the printing substrate web 3 between the synchronization sensor 21 and the oscillating guide 23 in the receiver unit AG. For this length $L_{(new2)}$ it then applies that:

b) $L_{(new2)}$=(1+(ΔL per web tension F)+(ΔL per change of the relative humidity rH))*length L of the printing substrate web 3 (from the oscillating guide 23 to the synchronization sensor 21), wherein ΔL is selected to be 1 mm, for example, and the length of the printing substrate web 3 is specified in mm.

The influence of the thickness d of the printing substrate web 3 and its width B can be accounted for via empirically determined correction factors.

The calculations of these lengths $L_{(new)}$ of the printing substrate web 3 can take place in the printer controller 2.

The length changes of the printing substrate web 3 from the adhesion point 24 to the synchronization sensor 21 and from the synchronization sensor 21 to the oscillating guide 23 can thus be calculated with the formulas for $L_{new}$. It is therefore possible to take into account the change of the length of the printing substrate web given the positioning of the printing substrate web 3 relative to the synchronization sensor 21 and relative to the oscillating guide 23.

For example, if the length of a new printing substrate web 3 to be inserted changes at the printing apparatus DR in comparison to the previous length, due to different climatic conditions or due to different web tension, thickness or width of the printing substrate web 3, this change is compensated in that the start of the printing substrate web 3 or a fold of the printing substrate web 3 is arranged offset by the length change at the adhesion point 24. With this it is ensured that a fold is present at the synchronization sensor 21 after drawing in the new printing substrate 3. The displacement of the start of the new printing substrate web 3 can be executed by the printer controller or by an operator, for example by operating the infeed roller 12.

With this displacement of the printing substrate web 3 it is also achieved that the newly drawn in printing substrate web 3 is correctly situated at the oscillating guide 23. Given a large length segment of the printing substrate web 3 between synchronization sensor 21 and the oscillating guide 23 (for example due to an extended drying route 11.2), a correction within the receiver unit AG can be required, for example at the oscillating guide 23; however, the magnitude of the displacement of a fold of the printing substrate web 3 is thereby known.

The problem of the length change of the printing substrate web 3 in particular occurs if a new stack of the printing substrate web 3 should be drawn into the printing apparatus DR, since the climatic conditions under which the stack was previously stored can differ from those that exist at the printing apparatus DR. It is then advantageous if, upon insertion of a new printing substrate web 3 into the printing apparatus DR, a calculation of whether the position of the printing substrate web 3 at the adhesion point 24 or the oscillating guide 23 needs to be corrected is made by the printer controller 2 using the information about: the thickness d and width B of the printing substrate web 3; the change of the relative humidity rH; and the web tension F to which the printing substrate web 3 is exposed on the transport arrangement 8. The displacement of the printing substrate web 3 can thereby be implemented by the printer controller 2 or by an operator. It typically takes place via movement or one or more driven rollers by defined path lengths, change of the web tension at the braking roller 15 or take-off roller 13, and/or via modification of the position of the axis of a transport roller.

In the description of the exemplary embodiments, a printing substrate web 3 that is folded in a zigzag shape and that can be provided with marginal perforations is designated as a stacked good. The length between two folds corresponds to a form length. The sensors used in the printing apparatus are commercially available.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. An ink printing apparatus, comprising:

a printing unit and a printer controller for printing to a pre-folded printing substrate web, the printing unit comprising print bars having print heads and a drying route;

a transport arrangement for the printing substrate web provided by the printing unit;

an intake unit arranged at an intake of the transport arrangement, an infeed roller of the intake unit being provided at an intake for the transport arrangement in order to transport the printing substrate web to the transport arrangement;

a synchronization sensor at the transport arrangement between the infeed roller and the printing unit and adjacent to the intake of the printing unit, said synchronization sensor emitting a respective synchronization signal when a fold of the printing substrate web is present at said synchronization sensor for synchronization of a printing operation with feed of the printing substrate web;

a transport path between the synchronization sensor and a freely accessible point of the intake unit being designed such that a fold is present at the synchronization sensor when the printing substrate web has a fold at the freely accessible point of the intake unit;

a sensor for measurement of relative humidity at the printing unit; and a measurement signal of the relative humidity by the sensor being compared in the printer controller with a relative humidity of an input stack of the printing substrate web to be inserted into the printing apparatus, and given a humidity deviation the printer controller calculating a length change of the printing substrate web between the synchronization sensor and the freely accessible point of the intake unit, the printing substrate web being displaced by the length change at the freely accessible point of the intake unit.

2. The ink printing apparatus according to claim 1 in which the printer controller incorporates a web tension on the printing substrate web in the transport arrangement, a thickness, and a width of the printing substrate web in the calculation of the length change.

3. The ink printing apparatus according to claim 1 in which the intake unit has an adhesion device to adhere together printing substrate webs, and wherein the adhesion device is provided at said freely accessible point of the intake unit.

4. The ink printing apparatus according to claim 1 wherein a receiver unit for the printing substrate web is provided, wherein at an intake of the receiver unit towards the transport arrangement a take-off roller is arranged in order to transport the printing substrate web from the printing unit to the receiver unit, the receiver unit having an output unit for placement of the printing substrate web on an output stack, said output unit comprising a placement roller and an oscillating guide wherein given a change of a length of the printing substrate web the take-off roller is controlled such that it moves the printing substrate web so that a fold of the printing substrate web is situated at the oscillating guide so that it places the printing substrate web on the output stack with correct folding.

5. The ink printing apparatus according to claim 4 wherein the printer controller calculates the length change of the printing substrate web between the synchronization sensor and the output unit given a difference of climate conditions of the printing apparatus and of the input stack of the printing substrate web, and displaces the printing substrate web by the length change at the oscillating guide.

6. The ink printing apparatus according to claim 5 wherein the printer controller incorporates web tension on the printing substrate web in the transport arrangement, a thickness and a width of the printing substrate web into the calculation of the length change of the printing substrate web.

7. The ink printing apparatus according to claim 1 wherein the drying route is subdivided into two shorter sub-routes of different length, and wherein, given print jobs in which less ink is consumed, the printing substrate web is only directed over one of the two shorter sub-routes of the drying route.

8. An ink printing apparatus, comprising:

a printing unit and a printer controller for printing to a pre-folded printing substrate web, the printing unit comprising print bars having print heads and a drying route;

a transport arrangement for the printing substrate web provided by the printing unit;

an intake unit at an intake for the transport arrangement in order to transport the printing substrate web to the transport arrangement;

a synchronization sensor at the transport arrangement between the intake unit and the printing unit, said synchronization sensor emitting a respective synchronization signal when a fold of the printing substrate web is present at said synchronization sensor for synchronization of a printing operation with feed of the printing substrate web;

a transport path between the synchronization sensor and a freely accessible point of the intake unit being designed such that a fold is present at the synchronization sensor when the printing substrate web has a fold at the freely accessible point of the intake unit;

a sensor for measurement of relative humidity at the printing unit; and the relative humidity at the printing unit being compared in the printer controller with a relative humidity of an input stack of the printing substrate web to be inserted into the printing apparatus, and given a humidity deviation the printer controller calculating a length change of the printing substrate web between the synchronization sensor and the freely accessible point of the intake unit, the printing substrate web being displaced by the length change at the freely accessible point of the intake unit.

* * * * *